US008166695B2

(12) United States Patent
Pippin

(10) Patent No.: US 8,166,695 B2
(45) Date of Patent: May 1, 2012

(54) HITCH MOUNTED SHOOTING SUPPORT

(76) Inventor: Robert W. Pippin, Mooresville, NC (US)

( * ) Notice: Subject to any disclaimer, the term of this patent is extended or adjusted under 35 U.S.C. 154(b) by 166 days.

(21) Appl. No.: 12/728,765

(22) Filed: Mar. 22, 2010

(65) Prior Publication Data

US 2011/0225866 A1 Sep. 22, 2011

(51) Int. Cl.
*F41A 23/56* (2006.01)
*B60R 9/06* (2006.01)

(52) U.S. Cl. ..... 42/94; 224/519; 280/769

(58) Field of Classification Search ... 42/94; 280/765.1, 280/769; 224/502, 509, 510, 519, 524; D22/108
See application file for complete search history.

(56) References Cited

U.S. PATENT DOCUMENTS

| | | | | | |
|---|---|---|---|---|---|
| 3,225,656 | A | * | 12/1965 | Flaherty et al. | 89/37.04 |
| 4,967,497 | A | * | 11/1990 | Yakscoe | 42/94 |
| 5,397,147 | A | * | 3/1995 | Ducharme et al. | 280/415.1 |
| 5,755,411 | A | | 5/1998 | Strong, III et al. | |
| 5,775,560 | A | * | 7/1998 | Zahn et al. | 224/524 |
| 5,833,308 | A | | 11/1998 | Strong, III et al. | |
| 6,173,705 | B1 | | 1/2001 | DeWitt | |
| 6,227,517 | B1 | | 5/2001 | Wohl | |
| D445,395 | S | | 7/2001 | Okerlund et al. | |
| 6,269,578 | B1 | | 8/2001 | Callegari | |
| 6,336,413 | B1 | | 1/2002 | Ball | |
| D466,394 | S | * | 12/2002 | Neider et al. | D8/354 |
| 6,511,088 | B2 | | 1/2003 | Kahlstorf | |
| 6,684,550 | B2 | | 2/2004 | Highfill | |
| 6,739,643 | B1 | | 5/2004 | Rock et al. | |
| 6,808,231 | B1 | | 10/2004 | Hill | |
| 6,871,440 | B2 | | 3/2005 | Highfill et al. | |
| 6,935,064 | B1 | | 8/2005 | Thompson | |
| 7,090,104 | B2 | | 8/2006 | Dorety | |
| 7,152,358 | B1 | | 12/2006 | LeAnna et al. | |
| 7,536,820 | B2 | | 5/2009 | Wade et al. | |
| 2003/0205599 | A1 | * | 11/2003 | Brown | 224/401 |
| 2005/0092213 | A1 | | 5/2005 | Wilson et al. | |
| 2006/0248775 | A1 | * | 11/2006 | Wade et al. | 42/94 |
| 2008/0006184 | A1 | | 1/2008 | Simon | |
| 2008/0061097 | A1 | | 3/2008 | Milender et al. | |
| 2008/0231029 | A1 | | 9/2008 | Hummel | |

* cited by examiner

*Primary Examiner* — Bret Hayes
(74) *Attorney, Agent, or Firm* — Price Heneveld LLP

(57) ABSTRACT

A shooting support includes a hitch-supported lower tube insertable into a vehicle hitch tube, an upper tube pivoted to the lower tube for angular adjustment toward the vehicle, and a table pivoted to the upper tube. The two pivots each include an arcuate slot around the respective pivot, and a clamp with handled nut for clampingly fixing an adjusted position. The upper tube also includes telescoping extendable tubes and a clamp for fixing its length. By this arrangement, a user sitting on the tailgate can infinitely adjust a length and angle of the upper tube to position the table at a desired horizontal and vertical location relative to the table and to the tailgate. A side handle on the upper tube is in a balanced position when the tubes and table are folded to parallel positions, such that the shooting support can be easily carried. Related methods are also disclosed.

19 Claims, 2 Drawing Sheets

HITCH MOUNTED SHOOTING SUPPORT

BACKGROUND

The present invention relates to shooting supports, sometimes called shooting benches, and more particularly relates to a shooting support for attachment to a vehicle hitch and that is adjustable to facilitate comfortable and accurate use.

It is known to mount a table or shooting apparatus to a hitch of a vehicle. However, improvement is desired to make the apparatus more useable and ergonomic, while not increasing cost, complexity, and difficulty of use, and also while not sacrificing stability, accuracy, and durability for long term use.

SUMMARY OF THE PRESENT INVENTION

In one aspect of the present invention, a shooting support for a vehicle including a tailgate and vehicle hitch tube, comprises a hitch-supported lower tube including a first end configured for insertion into and securement to the vehicle hitch tube and having a second end, and an angle-adjustable upper tube including a lower end and an upper end. The lower end is pivoted to the second end of the lower tube and is infinitely angularly adjustable between a vertical position and folded positions nearer the first end to thus define concave angles between 0 and 90 degrees with the lower tube. A first clamp is provided for securing the upper tube at an adjusted concave first angle on the lower tube. A shooting table is pivoted to an upper end of the upper tube and angularly adjustable to define angles with the upper tube, and a second clamp for securing the table to the upper end at an adjusted second angle on the upper tube. The upper tube includes first and second telescoping tubes adapted for extension and includes a third clamp for securing the first and second telescoping tubes in any one of an infinite number of desired extended positions. By this arrangement, a user can sit on the tailgate and infinitely adjust a length and angle of the upper tube to position the table at a desired horizontal and vertical location relative to the table and to the tailgate.

In a narrower aspect, a side handle is attached to the upper tube and the upper and lower tubes are foldable to a position parallel the table with the side handle in a center-of-gravity position for easy carrying.

In a narrower aspect, the three clamps include nuts with handles that can be grasped and rotated for quick and positive clamping.

In another aspect of the present invention, a shooting support for a vehicle including a tailgate and vehicle hitch tube, comprises a hitch-supported lower tube including a first end configured for insertion into and securement to the vehicle hitch tube and having a second end, and an angle-adjustable length-adjustable upper tube including a lower end and an upper end, the lower end including a first axis-defining hole and a first clamp-receiving hole. Parallel plate brackets are fixed to the second end and extend upwardly to define a space therebetween receiving the lower end, each bracket including a second axis-defining hole and an arcuate slot extending at least partially around the second axis-defining hole, the first clamp-receiving hole being aligned with a portion of the slot when the first and second axis-defining holes are aligned. An axle pin extends through the first and second axis-defining holes such that the upper tube is angularly adjustable from a vertical position toward the first end nearer the tailgate. A clamp includes a headed shaft extending through the clamp-receiving holes and the slots with a head engaging one of the plate brackets and including a handled nut threadably engaging the shaft and engaging the other of the plate brackets. The nut includes a handle that can be grasped to rotate the nut and clamp the brackets against the upper tube to fix a selected position. A table is attached to a top of the upper tube. By this arrangement, a user can infinitely adjust an angle and length the upper tube to position the table at a desired horizontal and vertical location relative to the table and to the tailgate.

In another aspect of the present invention, a method of adjusting a shooting support on a vehicle having a tailgate, comprises providing a shooting bench having a lower tube, a pivoted upper tube, and a pivoted table; inserting and then securing a first end of the lower tube to a vehicle hitch tube; adjusting an angle-adjustable upper tube on the lower tube to define a first angle between 0 and 90 degrees with the lower tube, including moving the table away from a vertical position over an outer end of the lower tube and moving the table toward the tailgate; clamping the upper tube to fix the first angle using a first clamp; adjusting a shooting table on the upper tube to define a second angle between 0 and 90 degrees with the upper tube; and clamping the table to fix the second angle using a second clamp. The upper tube includes first and second telescoping tubes adapted for extension and includes a third clamp for securing the first and second telescoping tubes in a desired extended position. The method further includes extending and then fixing a selected extended position using the third clamp. By this arrangement, a person shooting a gun can rest the gun on the table and also sit on the tailgate with their weight resting comfortably on the tailgate and with their arms, hands, and gun at an ergonomic position relative to their seated position.

The present invention also includes a novel, ornamental, and unobvious appearance embodied in the illustrated shooting support that provides surprising and unexpected benefits.

These and other aspects, objects, and features of the present invention will be understood and appreciated by those skilled in the art upon studying the following specification, claims, and appended drawings.

DETAILED DESCRIPTION OF PREFERRED EMBODIMENTS

The present apparatus (also called a "shooting support") includes a hitch-supported lower tube insertable into a vehicle hitch tube, an upper tube pivoted to the lower tube for angular adjustment toward the vehicle, and a table pivoted to the upper tube. The two pivots each include an arcuate slot around the respective pivot, and a clamp with handled nut for clampingly fixing an adjusted position. The upper tube also includes telescoping extendable tubes and a clamp for fixing its length. By this arrangement, a user sitting on the tailgate can infinitely adjust a length and angle of the upper tube to position the table at a desired horizontal and vertical location relative to the table and to the tailgate. A side handle on the upper tube is in a balanced position when the tubes and table are folded to parallel positions, such that the shooting support can be easily carried. Related methods are also disclosed.

Figure 1:
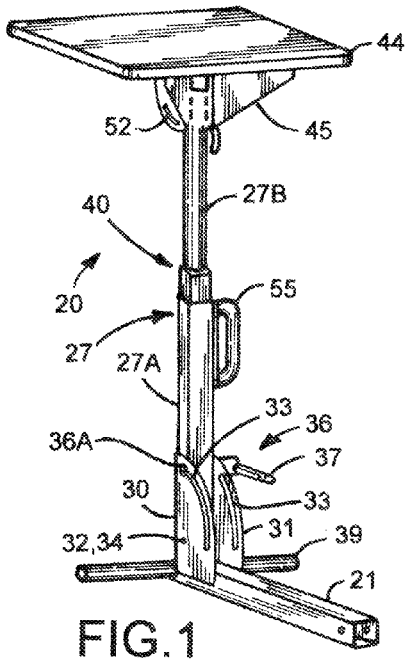
FIGS. 1-3 are front perspective, rear perspective, and side views of a shooting support in an upright position.
Figure 2:
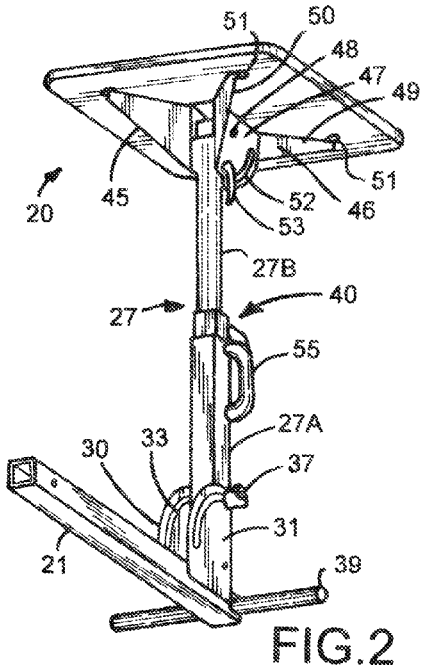
Figure 3:
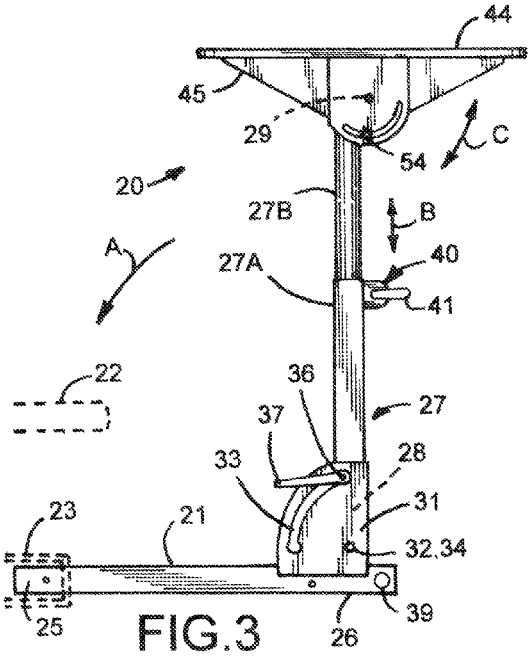
Figure 4:
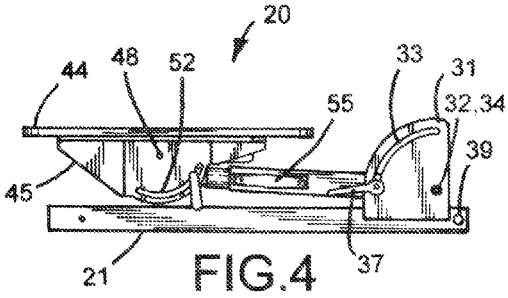
FIGS. 4-5 are opposite side views of the shooting support in a folded position.
Figure 5:
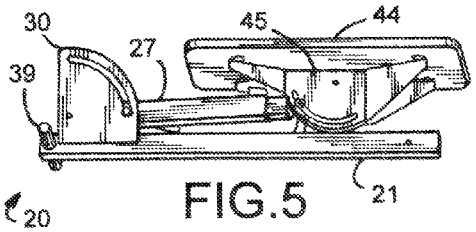
Figure 6:
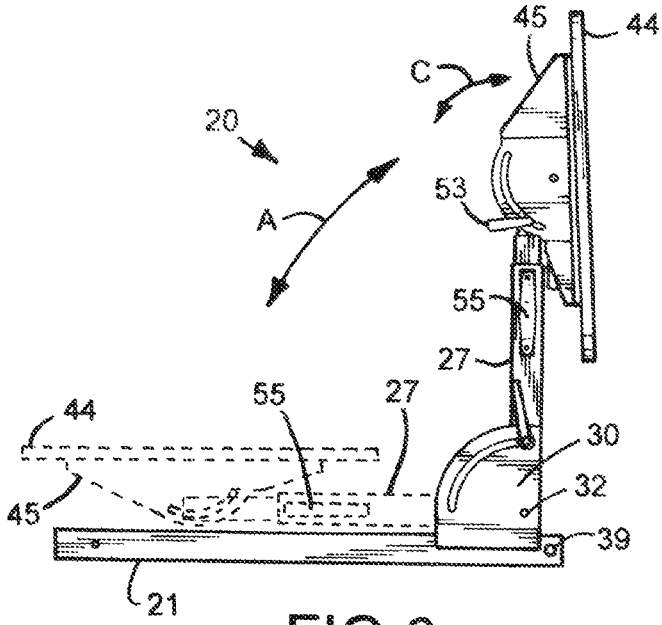
FIG. 6 is a side view of the shooting support with the upper tube adjusted to an upright position and the table adjusted to a folded position.
Figure 7:
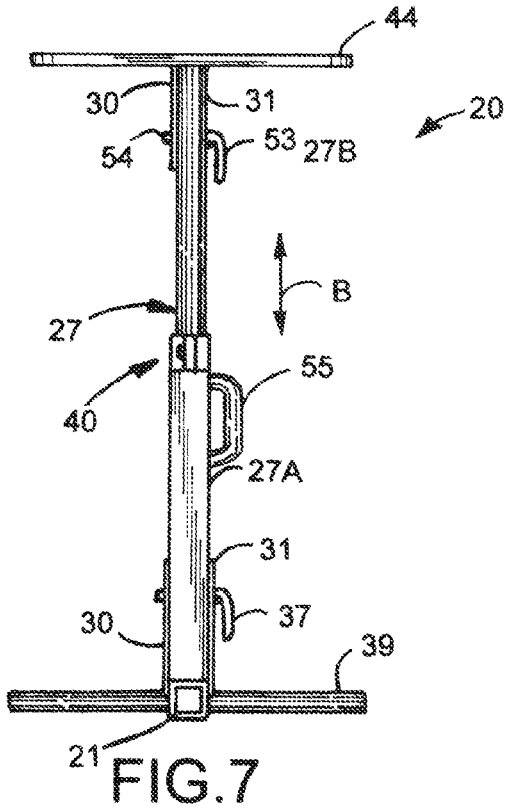
FIG. 7 is an end view of FIG. 3.

More specifically, the present shooting bench 20 (FIGS. 1-3) is provided for a vehicle 21 including a tailgate 22 and a vehicle hitch tube 23. The shooting bench 20 includes a hitch-supported lower tube 24 including a first end 25 configured for insertion into and securement to the vehicle hitch tube 23 and having a second end 26. A rod 39 extends transversely through the end of the lower tube 24 to provide a foot rest for a person using the present apparatus. An angle-adjustable upper tube 27 includes a lower end 28 and an upper end 29. The lower end 28 is pivoted to the second end 26 of the lower tube 24 by a pair of plate brackets 30 and 31 welded to sides of the lower tube 24. The brackets 30 and 31 include aligned holes 32 defining a pivot axis, and further include arcuate slots 33 that extend around the pivot axis at about 3-5 inches radius. An axle pin 34 includes a headed shaft that extends through the holes 32 and through an aligned hole in the lower end 28 of the upper tube 27, and a locked nut that combines with a head on the headed shaft to retain the axle pin 34 in position. A clamp 36 includes a headed shaft that extends through the slots 33 and through an aligned hole in the lower end 28 of the upper tube 27, and further includes a handled nut 37 threaded on the shaft. By grasping the handle on the handled nut, the nut 37 can be manually tightened to clamp the brackets 30 and 31 against the upper tube 27, thus frictionally holding a selected position. A length of the slots 33 limits an angular rotation of the upper tube 27 on the lower tube 24. The particular slots 33 allow rotation from a vertical position toward the tailgate of the vehicle between an infinite number of adjusted positions.

The upper tube 27 can be a single solid tube. However, as illustrated, it is made from a pair of telescopingly extendable tubes 27A and 27B, and includes a clamp 40. The clamp 40 includes a band fastened to the larger tube 27A and that closely engages the smaller tube 27B, and includes a rotatable handled nut 41 that can be rotated to tighten the band and secure the tubes 27A and 27B in an extended position. The combination of the angular adjustability of the upper and lower tubes 24 and 27 and with the extendable tubes 27A and 27B, a user can sit on the tailgate and infinitely adjust a length and angle of the upper tube and table 44 in directions A, B, C to position the table 44 at a desired horizontal and vertical location relative to the table and to the tailgate.

The table 44 is attached to the upper end 29 by a pair of brackets 45 and 46. Each bracket 45 and 46 includes a center panel section 47 adjacent the upper end 29 and pivoted to the upper end 29 by an axle pin 48 that extend through an aligned hole in the upper end 29, and further includes a pair of brace panels 49 and 50 angled away from the center panel section 47 toward corners of the table 44. The brackets 45 and 46 are fastened to the table 44 such as by attachment flanges and screws 51 at outer ends of the brace panels 49 and 50. Arcuate slots 52 are formed in the center panel sections 47 and extend around the axle pin 48. Clamps 53 include a headed shaft that extends through the arcuate slots 52 and through an aligned hole in the upper end 29 and further include a handled nut 54 engaging the headed shaft and rotatable to clamp the brackets 45 and 46 against the upper end 29 to fix its adjusted position.

The illustrated table 44 is fixed to the brackets 45 and 46 by screws 51. However, it is contemplated that the screws 51 can be replaced with leveling screws or other means so that the angle of the table 44 can be adjusted in a side-to-side direction perpendicular to the angle of rotation about axle pin 48.

A side handle 55 is attached to a side of the second tube 27A near a midpoint of tube 27. The side handle 55 is located at a general center-of-gravity when the first and second tubes 24 and 27 and table 44 are folded to a fully collapsed position where they lie basically parallel each other. This facilitates easy carrying and manipulation of the apparatus when being transported.

It is noted that the present design is believed to be novel, ornamental, and unobvious, and hence patentable.

It is to be understood that variations and modifications can be made on the aforementioned structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

1. A shooting support for a vehicle including a tailgate and vehicle hitch tube, comprising:

a hitch-supported lower tube including a first end configured for insertion into and securement to a vehicle hitch tube and having a second end;

an angle-adjustable upper tube including a lower end and an upper end, the lower end being pivoted to the second end of the lower tube and infinitely angularly adjustable between a vertical position and folded positions nearer the first end to thus define concave angles between 0 and 90 degrees with the lower tube;

a first clamp for securing the upper tube at an adjusted concave first angle on the lower tube;

a shooting table pivoted to an upper end of the upper tube and infinitely angularly adjustable to define angles between 0 and 90 degrees with the upper tube, the table including a flat table top and a pair of table-top-attachment brackets attaching the flat table top to the upper end, each of the table-top-attachment brackets including a pair of angled brace panels and a center panel section pivotally engaging the upper tube;

a second clamp for securing the table to the upper end at an adjusted second angle on the upper tube;

the upper tube including first and second telescoping tubes adapted for extension and including a third clamp for securing the first and second telescoping tubes in any one of a fully extended position, a fully retracted position, and an infinite number of desired partially extended positions therebetween;

whereby a user can sit on a tailgate and adjust a length and angle of the upper tube to position the table at a desired horizontal and vertical location relative to the table and to the tailgate.

2. The shooting support defined in claim 1, including a side handle attached to the upper tube near a center of gravity when the tubes and table are folded to a collapsed position approximately parallel each other to facilitate carrying when in the collapsed position.

3. The shooting support defined in claim 2, wherein the first and second clamps each include a headed shaft and a handled nut engaging the shaft for manual clamping.

4. The shooting support defined in claim 3, wherein the lower tube includes parallel side brackets with aligned holes that define a pivot axis and further include slots that extend arcuately around the aligned holes for receiving the first clamp.

5. The shooting support defined in claim 4, wherein the first clamp includes a shaft extending through the arcuate slots, the shaft engaging ends of the slot to limit angular adjustment of the upper tube on the lower tube to less than 90 degrees.

6. The shooting support defined in claim 1, wherein the first and second clamps each include a headed shaft and a handled nut engaging the shaft for manual clamping.

7. The shooting support defined in claim 1, wherein the lower tube includes parallel side brackets with aligned holes that define a pivot axis and further include slots that extend arcuately around the aligned holes for receiving the first clamp.

8. The shooting support defined in claim 7, wherein the first clamp includes a shaft extending through the arcuate slots, the shaft engaging ends of the slot to limit angular adjustment of the upper tube on the lower tube to less than 90 degrees.

9. The shooting support defined in claim 1, wherein the table includes opposing brackets each with a center panel and angled braces extending from the center panel, the center panels including aligned holes defining an axis of rotation for the table and the angled braces being attached to the table for stability.

10. The shooting support defined in claim 1, wherein the center panel sections each include a first arcuate slot, with the second clamp operably engaging the first arcuate slots.

11. The shooting support defined in claim 10, including a pivot pin spaced from the first arcuate slots and engaging the pair of table-top-attachment brackets and the upper tube.

12. The shooting support defined in claim 10, including tube-attaching brackets on the hitch-supported lower tube that pivotally support the angle-adjustable upper tube, the tube-attaching brackets each including a second arcuate slot and the first clamp engaging the second arcuate slots.

13. A shooting support for a vehicle including a tailgate and vehicle hitch tube, comprising:

a hitch-supported lower tube including a first end configured for insertion into and securement to a vehicle hitch tube and having a second end;

an angle-adjustable length-adjustable upper tube including a lower end and an upper end, the lower end including a first axis-defining hole and a first clamp-receiving hole;

parallel plate brackets fixed to the second end and extending upwardly to define a space therebetween receiving the lower end, each bracket including a second axis-defining hole and a first arcuate slot extending at least partially around the second axis-defining hole, the first clamp-receiving hole being aligned with a portion of the first arcuate slot when the first and second axis-defining holes are aligned;

an axle pin extending through the first and second axis-defining holes such that the upper tube is infinitely angularly adjustable between 0 and 90 degrees from a vertical position toward the first end nearer a tailgate;

a clamp including a headed shaft extending through the clamp-receiving holes and the slots with a head engaging one of the plate brackets and including a handled nut threadably engaging the shaft and engaging the other of the plate brackets, the nut including a handle that can be grasp to rotate the nut and clamp the brackets against the upper tube to fix a selected position; and a table attached to a top of the upper tube, the table including a flat table top and a pair of table-top-attachment brackets attaching the flat table top to the upper end, each of the table-top-attachment brackets including a pair of angled brace panels and a center panel section pivotally engaging the upper tube;

whereby a user can adjust an angle and length of the upper tube to position the table at a desired horizontal and vertical location relative to the tailgate.

14. The shooting support defined in claim 13, wherein the headed shaft includes a threaded portion and the nut threadably engages the shaft for manual clamping.

15. The shooting support defined in claim 13, wherein the center panels include aligned holes defining an axis of rotation for the table and the angled braces being attached to the table for stability.

16. The shooting support defined in claim 13, including a side handle attached to the upper tube near a center of gravity when the tubes and table are folded to a collapsed position approximately parallel each other to facilitate carrying when in the collapsed position.

17. A method of adjusting a shooting support on a vehicle having a tailgate, comprising:

providing a shooting bench having a lower tube, a pivoted upper tube, and a pivoted table, the table including a flat table top and a pair of table-top-attachment brackets attaching the flat table top to the upper end, each of the table-top-attachment brackets including a pair of angled brace panels and a center panel section pivotally engaging the upper tube;

inserting and then securing a first end of the lower tube to a vehicle hitch tube;

adjusting an angle-adjustable upper tube on the lower tube to define a first angle between 0 and 90 degrees with the lower tube, including moving the table away from a vertical position over an outer end of the lower tube and moving the table toward the tailgate;

clamping the upper tube to fix the first angle using a first clamp;

adjusting the table on the upper tube to define a second angle between 0 and 90 degrees with the upper tube;

clamping the table to fix the second angle using a second clamp;

wherein the upper tube includes first and second telescoping tubes adapted for extension and includes a third clamp for securing the first and second telescoping tubes in a desired extended position; and extending and then fixing a selected extended position using the third clamp;

whereby a person shooting a gun can rest the gun on the table and also sit on the tailgate with their weight resting comfortably on the tailgate and with their arms, hands, and gun at an ergonomic position relative to their seated position.

18. The method defined in claim 17, including collapsing the tubes and table to a generally-parallel collapsed position, and including steps of providing a handle on one of the tubes in a position near a center of gravity when in the collapsed position for balanced carrying, and carrying the support when in the collapsed position using the handle.

19. In combination, an arrangement comprising a shooting support; and a vehicle including a tailgate and vehicle hitch tube;

the shooting support including:

a hitch-supported lower tube including a first bracket with a first pivot and first arcuate slots extending partially around the first pivot;

an angle-adjustable upper tube pivoted to the first pivot and infinitely angularly adjustable between a vertical position and angled position nearer the first end to thus define concave angles between 0 and 90 degrees with the lower tube;

a first clamp engaging the first arcuate slots for securing the upper tube at an adjusted concave first angle on the lower tube;

a shooting table pivoted to an upper end of the upper tube and infinitely angularly adjustable to define angles between 0 and 90 degrees with the upper tube, the table including a flat table top and a pair of table-top-attachment brackets attaching the flat table top to the upper end, each of the table-top-attachment brackets including a second pivot and second arcuate slots extending partially around the second pivot;

a second clamp engaging the second arcuate slots for securing the table to the upper end at an adjusted second angle on the upper tube;

the upper tube including telescoping tubes adapted for extension and including a third clamp for securing the first and second telescoping tubes in any one of a fully extended position, a fully retracted position, and an infinite number of desired partially extended positions therebetween;

whereby a user sitting on the tailgate can adjust a length and angle of the upper tube to position the table at a desired horizontal and vertical location relative to the table and to the tailgate.

* * * * *